US010828688B2

(12) United States Patent
Schellin et al.

(10) Patent No.: US 10,828,688 B2
(45) **Date of Patent: *Nov. 10, 2020**

(54) ELASTOMER FORMED BEADED JOINT

(71) Applicant: Nelson Global Products, Inc., Stoughton, WI (US)

(72) Inventors: Robert Schellin, Stoughton, WI (US); Dennis Richard Mevissen, Waconia, MN (US); Timothy Fitzmaurice, Humbird, WI (US); Mark Vandervest, Victoria, MN (US); Jason Drost, Lake Mills, WI (US)

(73) Assignee: Nelson Global Products, Inc., Stoughton, WI (US)

( * ) Notice: Subject to any disclaimer, the term of this patent is extended or adjusted under 35 U.S.C. 154(b) by 195 days.

This patent is subject to a terminal disclaimer.

(21) Appl. No.: 16/015,721

(22) Filed: Jun. 22, 2018

(65) Prior Publication Data

US 2018/0361457 A1 Dec. 20, 2018

Related U.S. Application Data

(63) Continuation of application No. 15/638,801, filed on Jun. 30, 2017, now Pat. No. 10,010,922, which is a continuation of application No. 14/815,155, filed on Jul. 31, 2015, now Pat. No. 9,694,409.

(51) Int. Cl.

| | |
|---|---|
| ***B21D 26/033*** | (2011.01) |
| ***B21D 22/10*** | (2006.01) |
| ***B21D 15/10*** | (2006.01) |
| ***B21D 39/04*** | (2006.01) |
| ***B21D 39/06*** | (2006.01) |
| ***B21D 39/03*** | (2006.01) |

(52) U.S. Cl.

CPC ..... *B21D 26/033* (2013.01); *B21D 15/105* (2013.01); *B21D 22/105* (2013.01); *B21D 39/03* (2013.01); *B21D 39/04* (2013.01); *B21D 39/06* (2013.01)

(58) Field of Classification Search

CPC .. B21D 26/033; B21D 15/105; B21D 22/105; B21D 39/03; B21D 39/04; B21D 39/06

See application file for complete search history.

(56) References Cited

U.S. PATENT DOCUMENTS

| | | | |
|---|---|---|---|
| 2,458,554 | A | 1/1949 | Hull et al. |
| 3,627,336 | A | 12/1971 | Lawson |
| 4,006,619 | A | 2/1977 | Anderson |
| 4,068,372 | A | 1/1978 | Kamohara et al. |
| 4,685,191 | A | 8/1987 | Mueller et al. |
| 5,233,855 | A | 8/1993 | Maki et al. |

(Continued)

*Primary Examiner* — Teresa M Ekiert

(74) *Attorney, Agent, or Firm* — Smith Law Office; Jeffry W. Smith

(57) ABSTRACT

A method for forming a conduit with a radial flange for forming part of a beaded coupling by: positioning a conduit blank in a forming die, wherein the forming die defines a radially extending recess; inserting a forming post in the conduit blank to define an annular space therebetween; inserting a flexible material in the annular space between the post and the conduit; placing a sleeve in a bearing relationship with the flexible material; compressing the flexible material between the post and the sleeve to force the flexible material against the conduit to expand the conduit outward into engagement with the radially extending recess in the forming die to form an annular flange; and releasing compression on the flexible material.

6 Claims, 15 Drawing Sheets

(56) References Cited

U.S. PATENT DOCUMENTS

| | | | |
|---|---|---|---|
| 8,528,377 | B2 | 9/2013 | Ohara et al. |
| 9,694,409 | B2 | 7/2017 | Schellin et al. |
| 1,001,092 | A1 | 7/2018 | Schellin et al. |

ELASTOMER FORMED BEADED JOINT

CROSS REFERENCE TO RELATED APPLICATION

This application is a continuation of U.S. application Ser. No. 15/638,801, filed on Jun. 30, 2017, which is a continuation of U.S. application Ser. No. 14/815,155, filed on Jul. 31, 2015 issued Jul. 4, 2017 under U.S. Pat. No. 9,694,409, the disclosures of which is incorporated by reference herein.

FIELD AND BACKGROUND

This invention relates generally to a beaded conduit joint, sometimes referred to as "Marmon" conduit couplings, and more particularly to improved beaded couplings and methods for forming beaded couplings in conduit blanks.

Joining conduits is common in many products and systems, including vehicle engine exhaust systems. Beaded couplings (or "joints") are used to connect two conduits or other components. Beaded couplings are well known and include a first conduit having an end portion on which an outwardly extending annular flange is formed, and a second conduit having a flared end for mating with the annular flange. Once fitted together, the two conduits are releasably joined using a clamp that engages both the annular flange and the flared end to secure the two conduits together.

Various modifications to beaded couplings are known that improve various aspects of the couplings, but they all face similar obstacles in the manufacturing process. For example, mating faces of the outwardly extending annular flange and the flared end must match well enough to resist leaking and other failures. Gaskets between mating faces and in the clamp can be used, but tolerances must still be tight and consistent in high-performance applications.

Known manufacturing techniques for forming beaded couplings can result in poor fits and leaks between conduits. This is especially true in high pressure and temperature applications, such as engine exhaust systems where tolerances are tight. For example, some forming methods result in annular flanges with irregular profiles, tooling marks on sealing faces, and excessive thinning of conduit material at the outwardly extending annular flange and at the flared end of the mating conduit.

The annular flange and the flared end were typically formed by using an indexing/sizing machine having a multi-hit ram that forms and sizes the annular flange on one piece and a flared end on a mating piece of the coupling. The ram can change the thickness of the material in the formed profile, and the parts typically are not formed to "full print geometry," which is a term used to describe products with material extending fully into tight corners or recesses of forming dies. Such full print geometry products are difficult to obtain, especially with traditional index/sizing machines. Parts that do not have full print geometry may not be within manufacturing specifications and may even have wall thicknesses that are too thin because the wall material was stretched toward the extreme corners or recesses of the forming dies. To minimize the problems with thinning of the conduit wall material and related failures, the conduit walls are typically thick enough to compensate for the particular forming method being used, but the parts can still be outside of manufacturing tolerances when such manufacturing techniques are used. These prior manufacturing methods also leave noticeable tooling mark on the parts.

Additional complications in forming beaded couplings are apparent when one or both of the conduits is bent to form an elbow or is part of a component. In some situations to aid in manufacturing, a straight section of conduit is welded to an elbow after the beaded coupling elements are formed on a straight section. This additional step adds time and cost.

Thus, there is a need for a beaded coupling manufacturing method that reduces tooling marks, minimizes flaws from conduit thinning, has consistent results, and can be used with elbow conduits or when other components are connected to the conduit in advance.

SUMMARY OF THE INVENTION

The present invention is directed to methods for forming an annular flange on one section of conduit for use in a beaded coupling. Once such method in accordance with the present invention includes the steps of: positioning a conduit blank in a die; restraining the conduit blank with a die having an annular flange recess formed therein; inserting a flexible material such as an elastomer inside the first conduit; and applying an axial compression force to the flexible material to cause a radially outward expansion of the flexible material, force a portion of the conduit blank outwardly into engagement with the annular flange recess formed in the die, and thereby form a conduit with an annular flange.

Once the annular flange is formed, an additional step of trimming an end of the conduit can be performed. Using an extended conduit helps maintain the flexible material in the conduit to protect the flexible material during conduit forming. After the forming of the annular flange using the protected flexible material, the conduit can be trimmed to finished length and the flexible material can be reused.

Further, the present invention can also be used to ensure a more uniform wall thickness at the extreme outer reaches of the tooling die by allowing at least a portion of the conduit blank to move axially. Axial movement is possible by restraining only a portion of the conduit blank in the die, while allowing another portion of the conduit blank to move slightly in an axial direction. In this way, the annular flange is formed without substantially stretching the conduit blank wall into the die annular flange recess extremities, and instead the annular flange is formed from material that is nearly full thickness.

A method for forming a conduit with an annular flange for forming part of a beaded coupling, the method comprising the steps of positioning a conduit blank in a split forming die having a first die half defining a first portion of a radially extending annular recess, and a second die half defining a second portion of a radially extending annular recess, wherein the first die half and the second die half are initially spaced apart inserting a flexible material in the conduit blank; moving the first die half toward the second die half and compressing the flexible material to force the flexible material against the conduit blank and force a portion of the conduit blank outward into engagement with the first portion of a radially extending annular recess and the second portion of a radially extending annular recess.

Such a process forms an annular flange to within manufacturing tolerances of specified dimensions ("print profile") with minimal tooling marks and with minimal thinning of the conduit material. This process can be used on a previously formed (bent) tube or conduit, which is more efficient than forming only straight sections of conduit that are later welded to a formed section of conduit or tube.

DETAILED DESCRIPTION OF THE DRAWINGS

Figure 1:
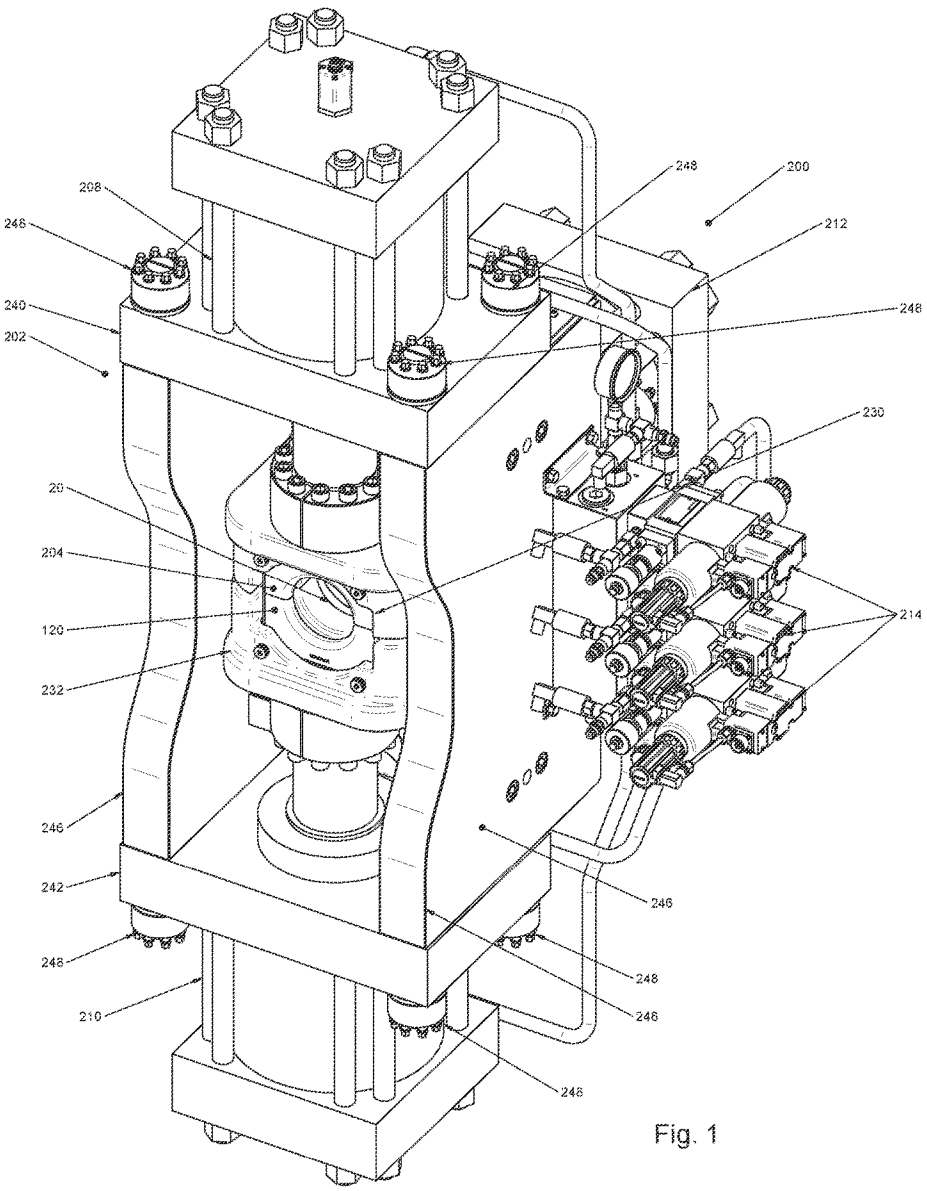
FIG. 1 is a perspective view of a beaded joint forming a machine in accordance with the present invention.
Figure 2B:
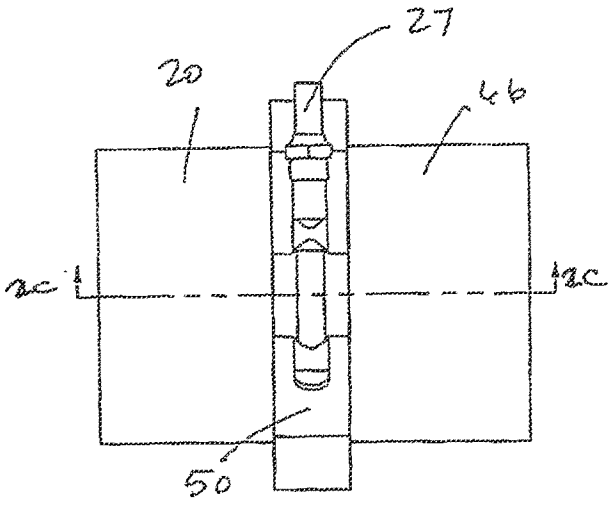
FIG. 2B is a side view of a beaded coupling of FIG. 2A.
Figure 2C:
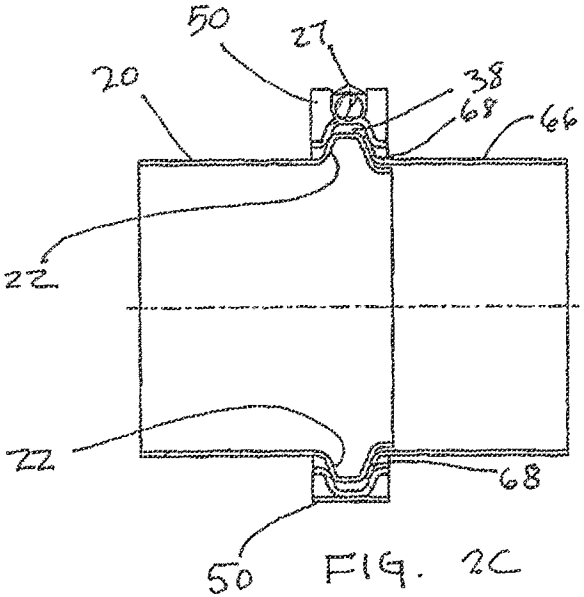
FIG. 2C is a partial cross-sectional view of a beaded joint taken along line 2C-2C in FIG. 2B.
Figure 2A:
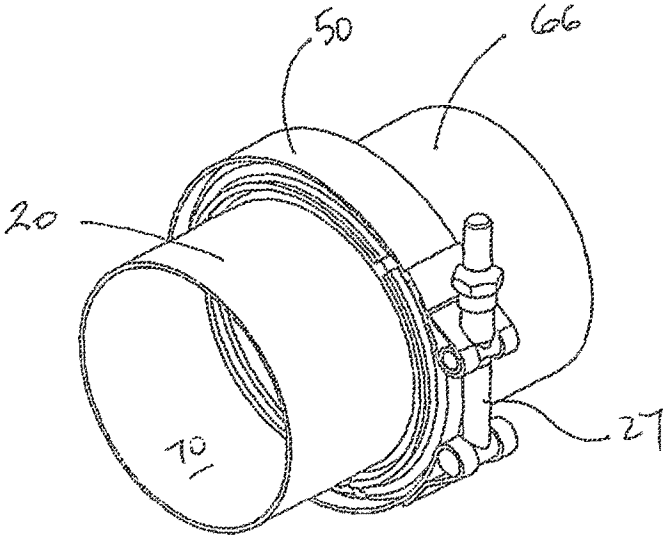
FIG. 2A is a perspective view of a beaded coupling in a clamped arrangement.
Figure 3B:
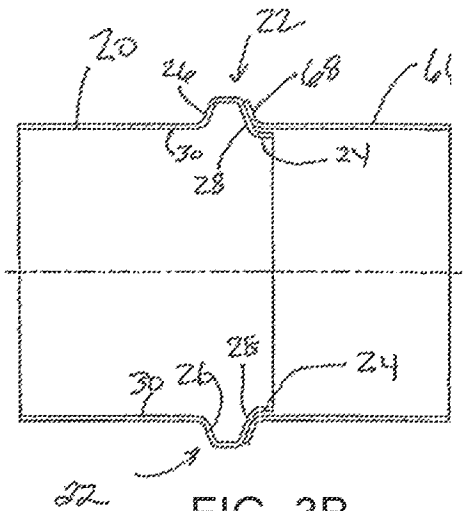
FIG. 3B is a partial cross-sectional view of the beaded joint in FIG. 3A.
Figure 3A:
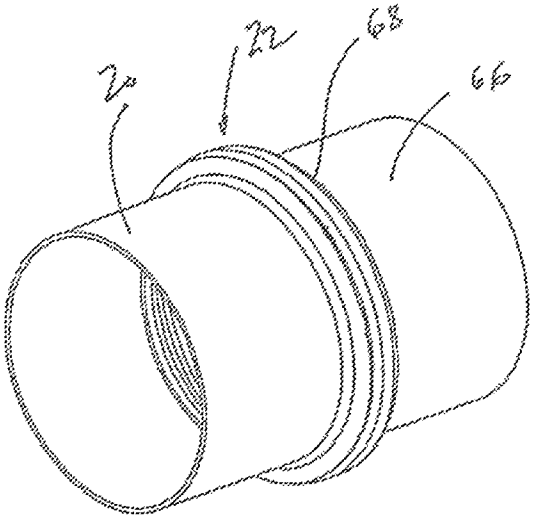
FIG. 3A is a perspective view of a beaded coupling in an unclamped arrangement.

In the following detailed description of drawings, the same reference numeral will be used to describe the same or similar element in each of the figures. Further, the elements in the figures are oriented horizontally, but they can be arranged vertically or in any other desired orientation in the present invention.

Illustrated in FIG. 1, is a beaded joint forming machine 200 in accordance with the present invention and for performing methods of forming a portion of a beaded joint in accordance with the present invention. The joint forming machine 200 includes a frame 202, an upper clamp 204, a lower clamp 206, an upper clamp actuator 208, a lower clamp actuator 210, an energizer actuator 212, and actuator controls 214.

Joined to the upper clamp 204 is an upper die holder 230, and joined to the lower clamp 206 is a lower die holder 232. The die holders 230 and 232 hold dies 120 that are described in detail below.

Actuator controls 236 are used to control movement and timing of the upper clamp actuator 208, the lower clamp actuator 210, and the energizer actuator 212.

The frame 202 includes a top 240, a bottom 242, and two sides 246, all joined together using connectors 248 suitable to hold the frame 202 together under actuator forces as high as 230,000 pounds, and outward pressures of about 30,000 pounds per square inch ("psi"), for example.

With reference to FIGS. 2A through 3B, a component or conduit 20, such as a conduit from an engine or exhaust after treatment device (for example, the engine or exhaust after treatment device not shown), is shown to include a "bead" in the shape of an annular flange 22 formed on in the wall of the conduit 20 adjacent to an end portion 24 of the conduit 20. Generally, a beaded flange 22 is an annular flange extending radially outwardly from the diameter of the conduit 20 to provide a surface to which a flared end 68 on another conduit 66 can mate and be prevented from sliding inwardly past the annular flange 22. The annular flange 22 also serves as a location on which a clamp 50 can be secured to releasably join the two conduits 20 and 66 together. The clamp 50 can include any mechanism 27 for securing the coupling, including the nut and bolt arrangement illustrated in FIGS. 2A through 2C.

The annular flange 22 includes first and second side surfaces 26, 28, and an interior surface 29 extending radially outwardly from a base surface 32 of the conduit 20. The side surfaces 26, 28 preferably converge as they extend radially outwardly from the base 32. A portion of the annular flange 22 that includes the surfaces 26 and 28 can be frustoconical in cross-section, but other shapes are possible as well, and are within the definition of an annular flange or bead, as those terms are used herein.

As seen in FIGS. 2A through 3B, the second component or conduit 66, to be joined to the conduit 20 described above, can include the flared end portion 68 having an annular ramped or concave interior surface and a matching annular ramped or convex exterior surface, or clamp engagement surface. These surfaces are preferably continuously annular and ramped or spherical surfaces, as illustrated, but they can be discontinuous and shaped differently than illustrated, as well. A portion of the interior surface is shown abutting a portion of the outer side surface 28 of the radial flange 22 on the adjacent conduit 20.

Figure 4:
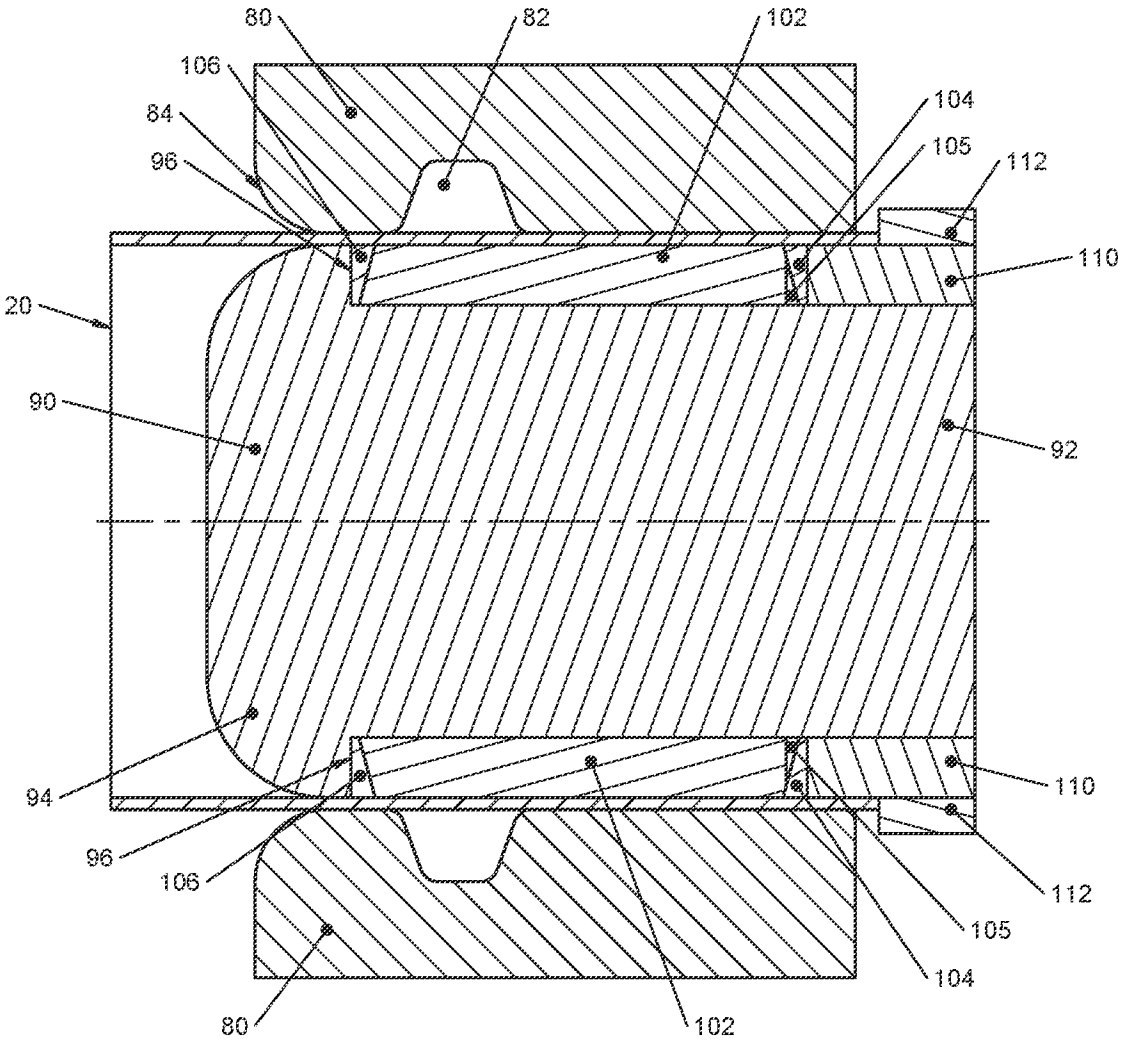
FIG. 4 is a partial cross-sectional view of a conduit blank positioned in a forming die and with a fixed reaction post, an elastomer, sealing wedges, and an energizing sleeve disposed therein, prior to forming the beaded conduit.
Figure 5:
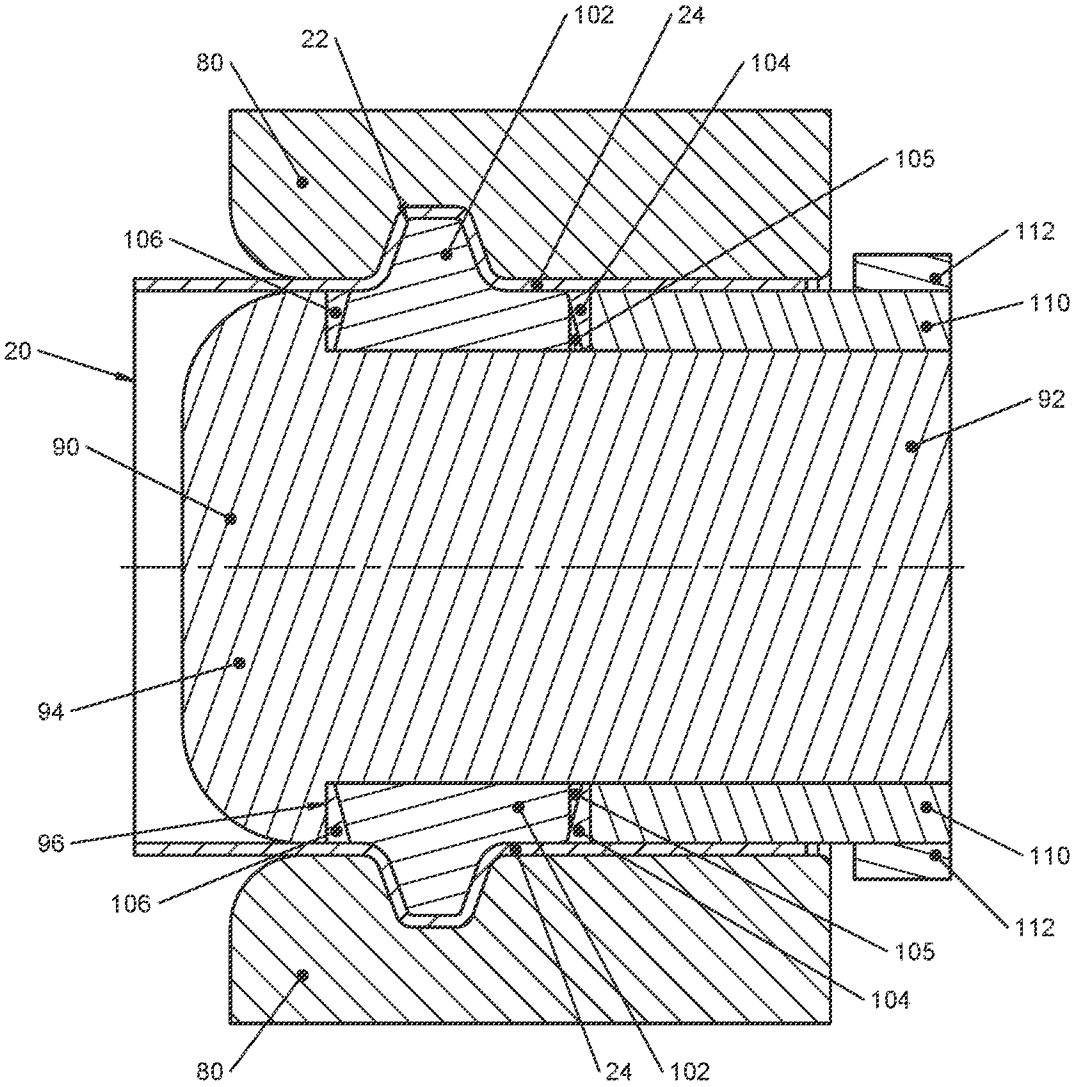
FIG. 5 is a conduit blank of FIG. 4 during a forming step.
Figure 6:
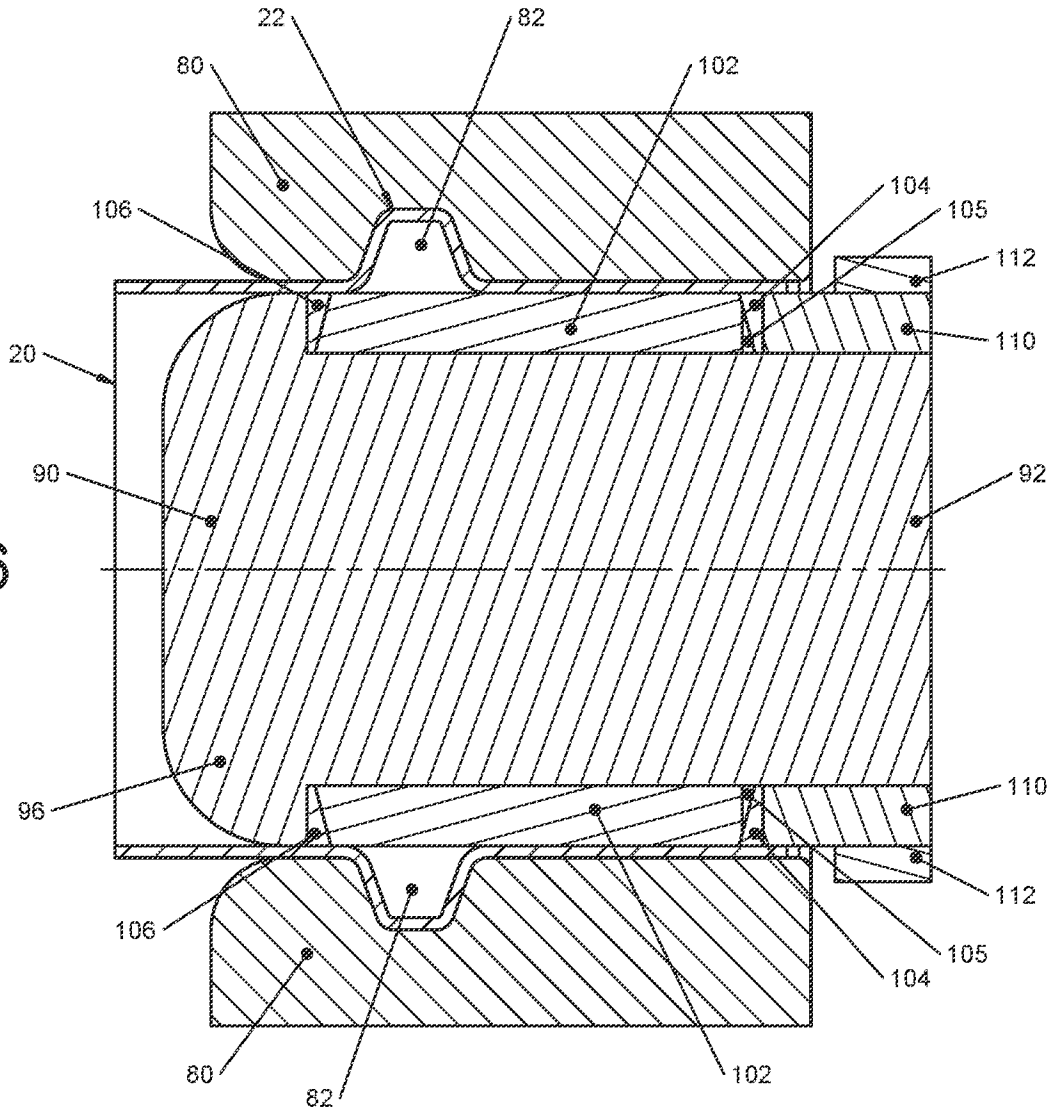
FIG. 6 is a conduit blank with an annular flange after the forming step of FIG. 5.

Steps of a manufacturing method in accordance with the present invention are illustrated in FIGS. 4 through 6, which show a conduit 20 having an end portion 24; a forming die 80 with an annular recess 82 and a tapered end 84; a fixed reaction post 90 having a shaft 92, a rounded end 94, and a reaction surface 96; an elastomer material 102 with sealing wedges 104 and 106 on each end of the elastomer material 102; a second sealing wedge 105; and an energizing sleeve 110 with a loading stop 112.

To form a radial flange in the conduit 20, the conduit blank 20 is disposed in the forming die 80 with the end portion 24 extending beyond (to the right of) the forming die 80. Preferably, at least a portion of the conduit blank 20 is unrestrained, so that the unrestrained portion can move axially when pressure is applied to form the annular flange 22. The conduit blank 20 is illustrated as being cylindrical and straight, but other shapes are possible including a conduit 20 with a bent portion that would be positioned to outside of the forming die 80 (to the left as illustrated).

The forming die 80 is formed in at least two portions (split), but it can have any number of portions that are separable so that a completely formed conduit with an annular flange 22 can be removed after forming.

The forming die 80 has formed therein the annular recess 82 machined to any desired shape and tolerance to form the radially extending annular flange 22.

The fixed reaction post 90 is disposed in the conduit blank 20 so that the rounded end 94 matches an internal diameter of the conduit 20. The shaft 92 of the reaction post 90 as a smaller external diameter compared to the internal diameter of the conduit 20. An annular space 114 is defined between the reaction post shaft 92 and the conduit blank 20.

The elastomer material 102 is disposed in the annular space 114 where it will be compressed by the energizing sleeve 110 with about 90,000 of force, for example, but a wide range of forces is possible and can be determined based on the forming pressures needed for a given part's material properties and the desired final shapes of the parts. Preferably, the elastomer material 102 is a black polyurethane rod of suitable dimensions to match the inside diameter of the beaded joint, and have a Durometer hardness of about 90, for example, but other Durometers can be used depending on the amount of force necessary to form the parts and to avoid damaging the elastomer so it can be reused. The elastomer 102 can be damaged when it is too soft because it can flow around the wedges and rams and also stick to the parts being formed. If too rigid, the elastomer 102 may not be resilient enough to be returned to a desirable shape for use in subsequent forming operations. The elastomer described herein is a preferred embodiment, but any material that is flexible enough to move into recesses in a die and retain most of its volume, so it cannot be compressed to the point where it fails to transmit the required conduit forming loads, is acceptable and within the definition of "flexible material," as used herein. The elastomer material 102 will be under intense pressure during the compressing step (FIG. 5), and it is preferable to seal the elastomer material 102 with sealing wedges 104, 105, and 106 to prevent the elastomer material 102 from being forced around the fixed reaction post 90 and the conduit 20, and/or around the energizing sleeve 110 and the conduit 20.

The energizing sleeve 110 is driven by a hydraulic post that can apply an axial force of as about 90,000 pounds to the elastomer material 102. The elastomer material 102 translates the axial force to a radial outward pressure against the conduit blank 20 to form the annular flange 22. The radial outward pressure is preferably about 30,000 psi, but the actual pressure needed depends on the material properties of the part being formed and the shapes into which the part will be formed.

The first step of the manufacturing method is illustrated in FIG. 4 where the conduit blank 20 in its "blank" or preformed cylindrical state is placed in the forming die 80 and the other forming elements are disposed at least partially inside the conduit blank 20. Preferably, the conduit blank 20 is restrained somewhat in the forming die 80, but a small amount of axial movement is desirable so that the conduit blank 20 can slide axially in the forming die 80 as the annular flange 22 is formed. Some axial movement of the conduit blank 20 is preferred to allow the annular flange 22 to be formed by bending the conduit blank 20 outward to fill the annular recess shape 82 instead of stretching and thinning the material if the conduit blank 20 were restrained from axial movement. A portion of the conduit blank 20 can be restrained from axial movement to control the location in the conduit blank 20 where the annular flange 22 is formed in another preferred embodiment.

In FIG. 5, the energizing sleeve 110 has moved to the left, as illustrated, to compress the elastomer material 102. The force against the elastomer material 102 is resisted by the reaction surface 96 of the reaction post 90, so that the elastomer material 102 is reshaped and applies a radially outwardly pressure against the conduit blank 20. The forming die 80 resists the pressure against the conduit blank 20 in all locations except at the annular recess 82, which is the location where the tube blank 20 expands until it reaches the annular recess shape 82 in the forming die 80. The substantially uniform outward pressure of the elastomeric material 102, results in a annular flange 22 having a substantial match with the die (or "full print" geometry), which might otherwise be unattainable with a multi-hit ram. Further, as stated above, by allowing at least a portion of the conduit blank 20 to move axially within the forming die 80, the material forced outwardly to form the annular flange 22 does not need to stretch as much as it would if the entire conduit blank 20 were restrained. This results in a wall thickness in the annular flange 22 that is at or close to full thickness.

After the energizing sleeve 110 is released and moves back toward the right (as illustrated in FIG. 6), the conduit 20 is left with an annular flange 22.

Figure 7:
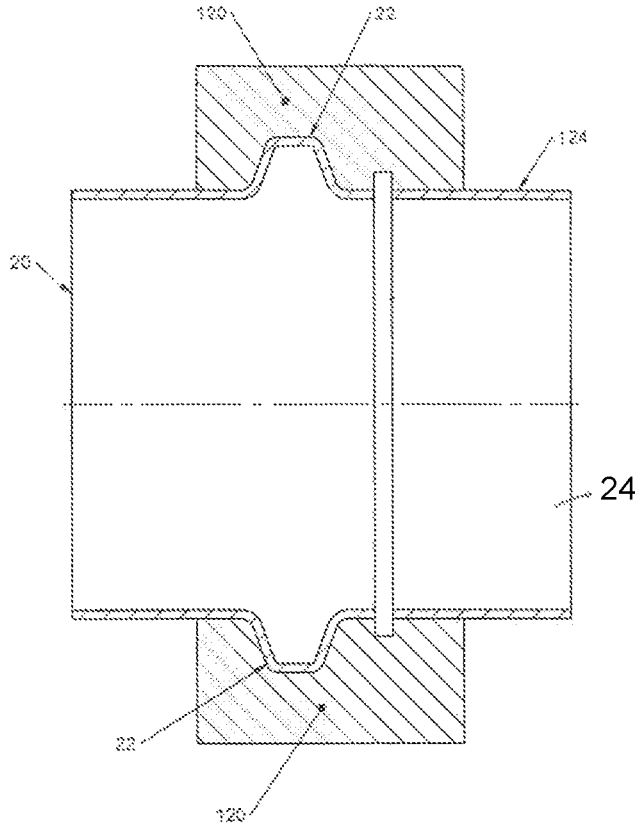
FIG. 7 is a partial cross sectional view of the conduit of FIG. 6 disposed in a trimming die.

An optional additional step is illustrated in FIG. 7, which illustrates the conduit 20 positioned in a trim die 120, so that the end portion 24 of the conduit 20 can be trimmed to any desired length. A scrap part 124 is removed and disposed. The trim die 120 is preferably split so that it can be opened and closed for positioning and removal of the conduit 20.

Figure 8:
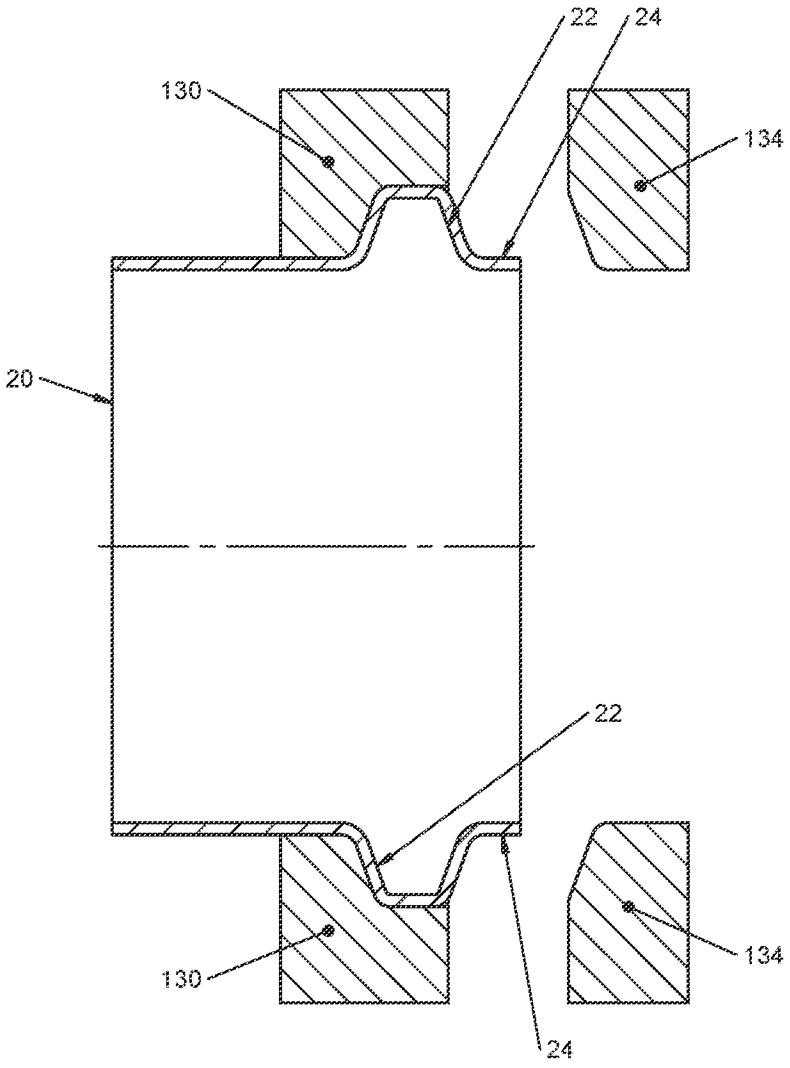
FIG. 8 is a partial cross sectional view of a conduit with an annular flange formed therein and disposed in a reducing die for reducing the conduit end diameter.
Figure 9:
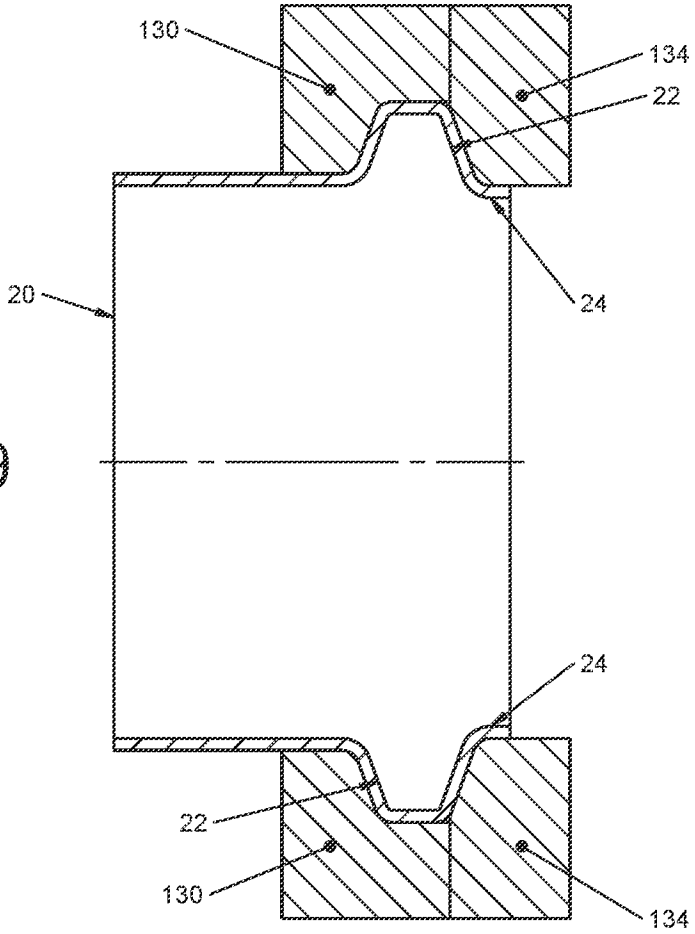
FIG. 9 is the conduit of FIG. 8 with the reducing die engaging the conduit end.
Figure 10:
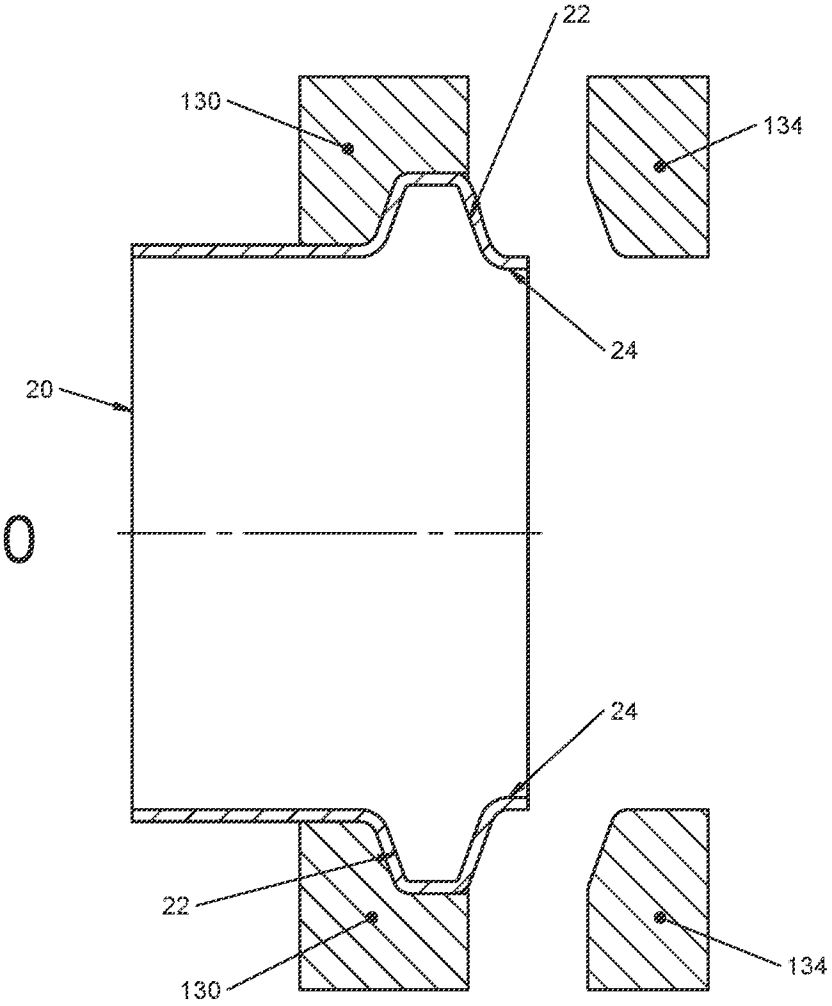
FIG. 10 is the conduit of FIG. 8 with the reducing die retracted and the conduit end diameter reduced.

If desired, the conduit end portion 24 can be further shaped, as in the example of a diameter-reducing process illustrated in FIGS. 8 through 10. In this part of the process, the formed conduit 20 with the annular flange 22 and the end portion 24 is placed in a clamping die 130 with the end portion 24 extending outward and exposed to reducing die 134 (FIG. 9) that is tapered, as illustrated, to reduce the diameter of the end portion 24 of the conduit 20 (FIG. 10). Other optional shaping operations can be performed at this stage as well.

Figure 11:
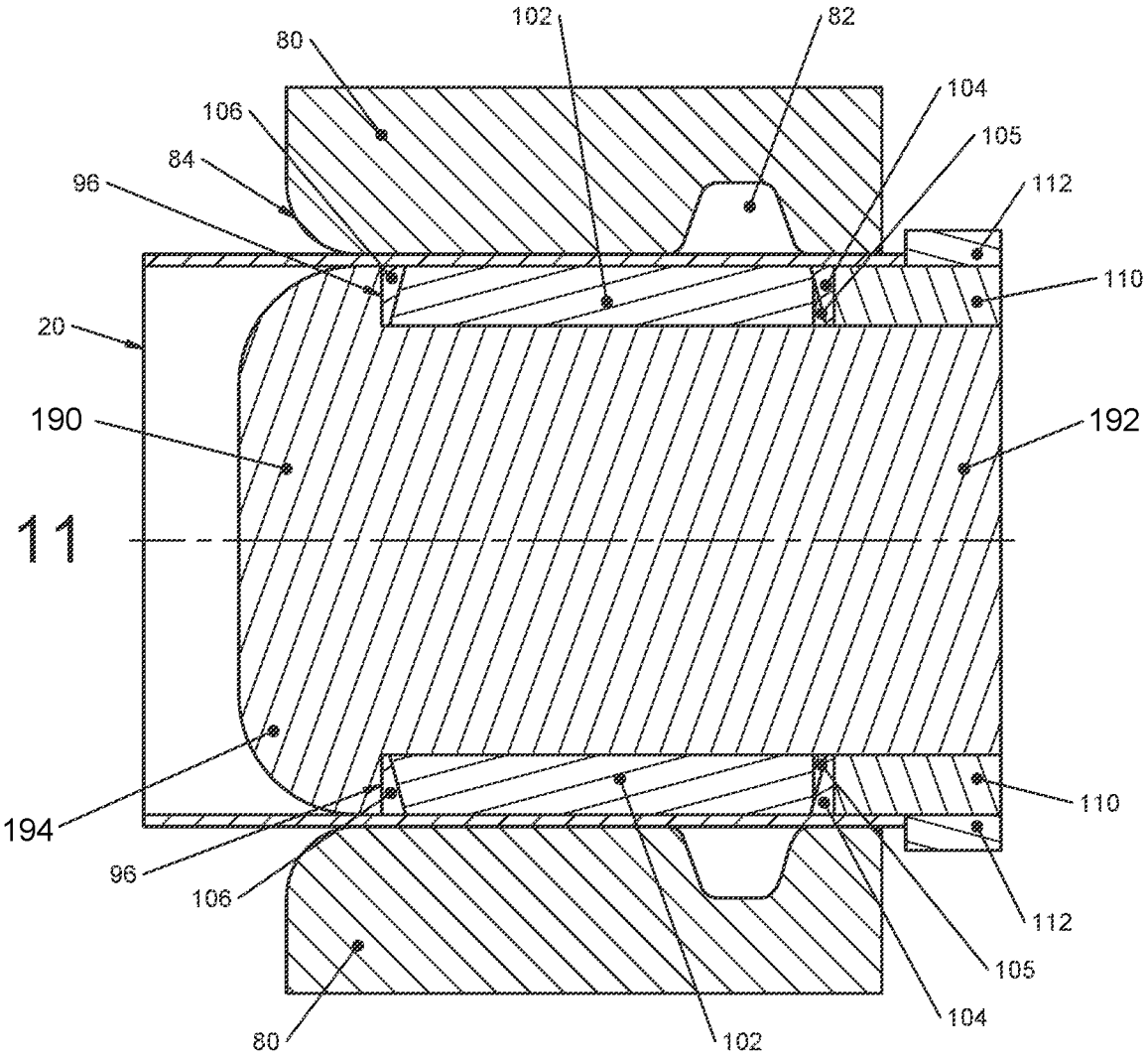
FIG. 11 is a partial cross-sectional view of a conduit blank positioned in a forming die and with an energizing post, an elastomer, sealing wedges, and a reaction sleeve disposed therein, prior to forming the beaded conduit.
Figure 12:
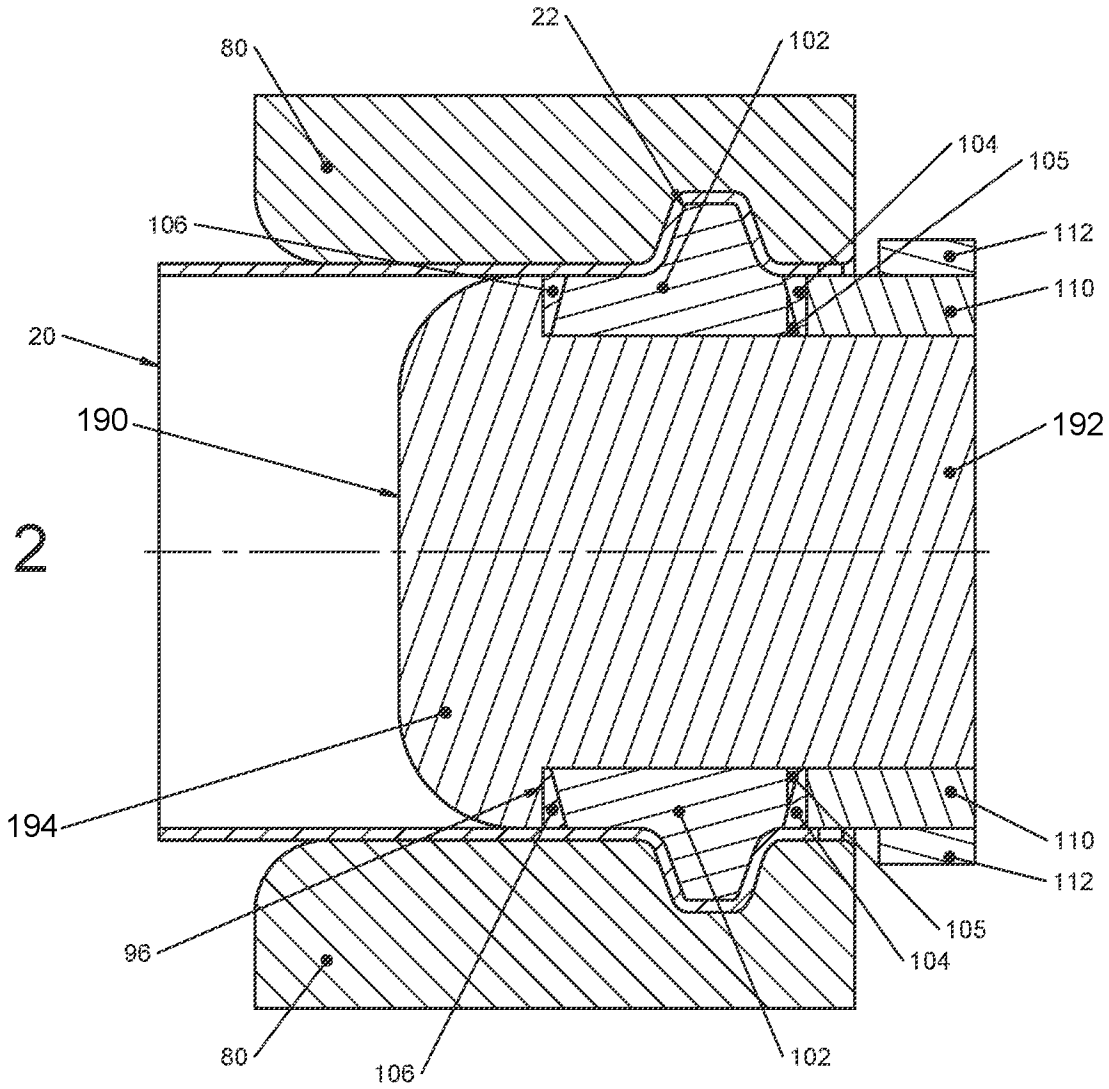
FIG. 12 is the conduit blank of FIG. 11 during a forming step.
Figure 13:
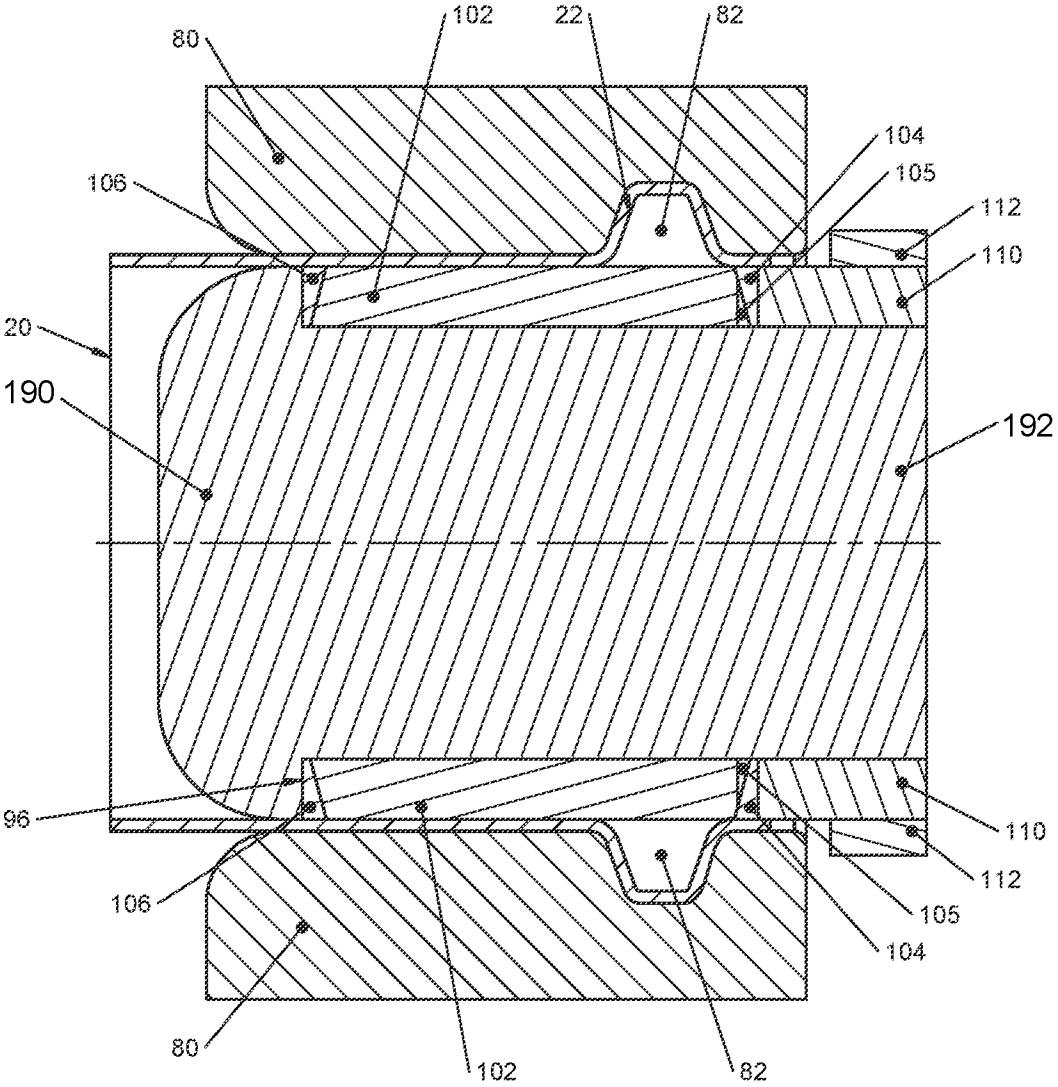
FIG. 13 is a conduit with an annular flange after the forming step of FIG. 12.

Steps of an alternate manufacturing method in accordance with the present invention are illustrated in FIGS. 11 through 13. The elements in each of these figures are similar in some ways to those described above, and include a conduit 20 having an end portion 24; a forming die 80 with an annular recess 82 and a tapered end 84; an energizing post 190 having a shaft 192, a rounded end 194, and a bearing surface 196; an elastomer material 102 with sealing wedges 104, 105, and 106 on each end of the elastomer material 102; and a reaction sleeve 210 with a loading stop 112.

To form an annular flange 22 in the conduit 20, the conduit blank 20 is disposed in the forming die 80 with the end portion 24 extending toward the right of the forming die 80 (FIG. 11). The conduit blank 20 is illustrated as being cylindrical and straight, but other shapes are possible including a conduit 20 with a bent portion that would be positioned to outside of the forming die 80 (to the left as illustrated). As described above, the conduit blank 20 is preferably at least partially unrestrained from axial movement to accommodate the forming process and maintain maximum thickness of the conduit wall in the annular flange 22 area.

As in the above example, the forming die 80 is formed in at least two portions (split), but it can have any number of portions that are separable so that a completely formed conduit 20 with an annular flange 22 can be removed after forming.

The forming die 80 has formed therein the annular recess shape 82 machined to any desired shape and tolerance to form an annular flange 22.

The energizing post 190 is disposed in the conduit blank 20, so that the rounded end 194 matches an internal diameter of the conduit 20. The shaft 192 of the energizing post 190 as a smaller external diameter compared to the internal diameter of the conduit 20. An annular space 114 is defined between the energizing post shaft 192 and the conduit blank 20.

The elastomer material 102 is disposed in the annular space 114 where it will be compressed by a force as described above, by the energizing post 190 moving toward the right, as illustrated. The elastomer material 102 will be under intense pressure during the compressing step (FIG. 10), and it is preferable to seal the elastomer material 102 with sealing wedges 104, 105, and 106 to prevent the elastomer material 102 from being forced around the energizing post 190 and the conduit 20, and/or around the reaction sleeve 210 and the conduit 20. The reaction sleeve 210 in this embodiment is stationary.

The first step of this embodiment of the manufacturing method is illustrated in FIG. 11 where the conduct 20 in its "blank" or cylindrical state is placed in the forming die 80 and the other elements are disposed at least partially inside the conduit 20.

In FIG. 12, the energizing post 190 has moved to the right, as illustrated, to compress the elastomer material 102. The pressure against the elastomer material 102 is resisted by the reaction sleeve 210, so that all of the pressure of the elastomer material 102 is applied against the conduit 20. The forming die 80 resists outward pressure from the elastomer material 102 against the conduit 20 in all locations except at the annular recess shape 82, which is the location where the tube blank 20 expands until it reaches the annular recess 82 in the forming die 80.

After the energizing post 190 is released and moves back toward the left (as illustrated in FIG. 13), the conduit 20 is left with an annular flange 22.

Figure 14:
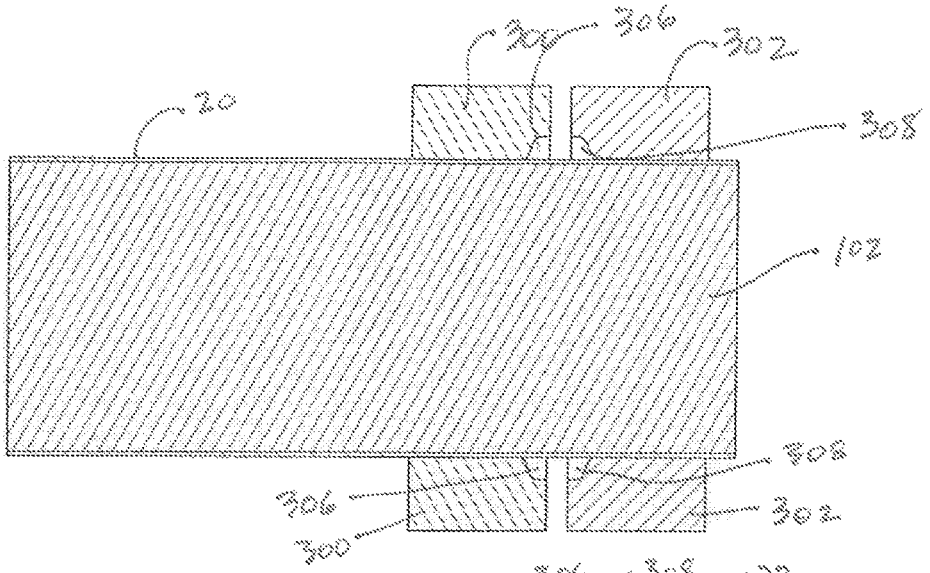
FIG. 14 is a partial cross-sectional view of a conduit blank positioned in a split forming die with axially movable die halves used to form a conduit with a bead (annular flange) and prior to forming.
Figure 15:
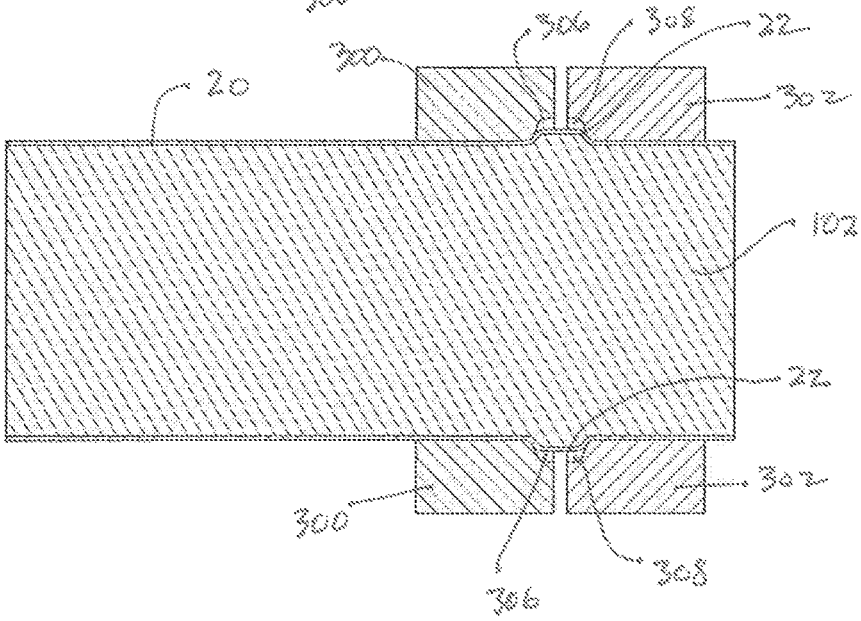
FIG. 15 is the conduit blank and the split forming die of FIG. 14 in a forming step.
Figure 16:
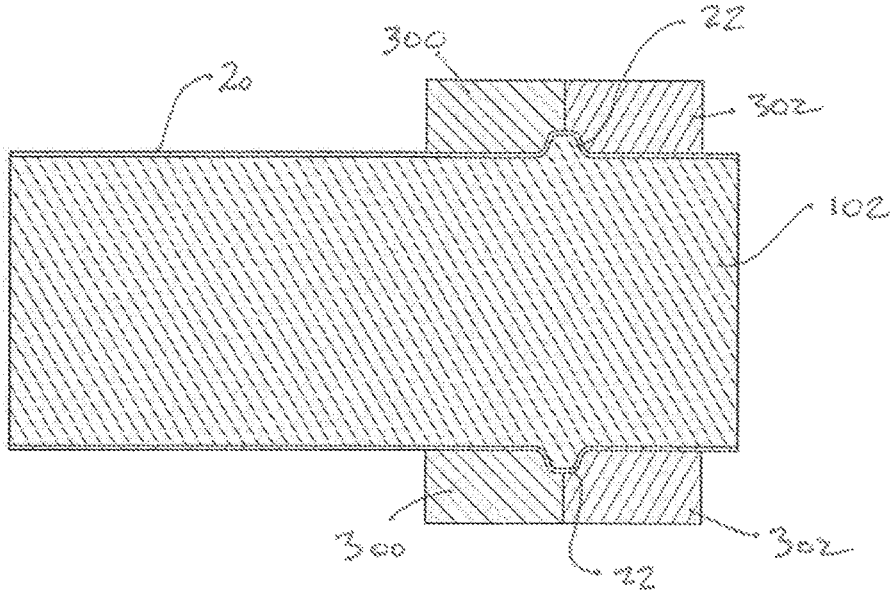
FIG. 16 is the conduit with a completely formed annular flange and the split forming die of FIG. 14.

Another exemplary embodiment of the present invention is illustrated in FIGS. 14 through 16, which illustrate forming an annular ("beaded") flange 22 on a conduit 20 using the elastomer material 102 and a split die having a die first half 300 and a die second half 302.

In this embodiment, the two die halves 300 and 302 move toward one another at the same time force is applied to the elastomer material 102, so that both the die movement and the elastomer compression are synchronized to form the annular flange 22. One or both of the die first half 300 and the die second half 302 are movable in an axial direction of the conduit 20 to make contact with one another, as illustrated in FIG. 16.

Another exemplary embodiment of the present invention is illustrated in FIGS. 14 through 16, which illustrate forming an annular ("beaded") flange 22 on a conduit 20 using the flexible material such as an elastomer material 102 and a split die having a die first half 300 and a die second half 302.

In this embodiment, the two die halves 300 and 302 move toward one another at the same time force is applied to the elastomer material 102, so that both the die movement and the elastomer compression are synchronized to form the annular flange 22. One or both of the die first half 300 and the die second half 302 are movable in an axial direction of the conduit 20 to make contact with one another, as illustrated in FIG. 16.

The die first half 300 defines half of an annular recess 306 and the die second half 302 defines a mating half of an annular recess 308, so that when the die first half 300 is adjacent to the die second half 302, a complete annular recess is defined by the two halves 306 and 308, as seen in FIG. 16.

In a manufacturing method of this embodiment, according to the present invention, the conduit blank 20 is placed in the die first half 300 and the second die half 302. Each die half 300 and 302 is itself split longitudinally to enable the removal of a formed beaded conduit 20, but the longitudinal split is not visible in figures. The elastomer material 102 is prepared with sealing wedges, as described above, and an energizing sleeve is forced against the elastomer material 102, in the manner described above to translate the axial load of the energizing sleeve into a radial outward pressure applied by the elastomer material 102.

As the radial outward pressure applied by the elastomer material 102 causes the conduit blank 20 to expand outwardly, the die first half 300 is moved toward the die second half 302 in a preferably synchronized manner, so that the die halves 300 and 302 meet at about the same time as (or slightly ahead of) the full movement of the elastomer material 102 to complete formation of the annular flange 22.

Preferably, the tube blank 20 is at least partially unrestrained by the die halves 300 and 302 to permit movement of the tube blank 20 in an axial direction as the annular flange 22 is being formed. Preferably, the die half 302 does not restrain axial movement of the conduit blank 20, but either or both of the die halves 300 and 302 can move relative to the conduit blank 20. In this manner, the tube blank 20 wall at the location of the radial flange 22 does not need to stretch and become thin when the annular flange 22 is formed because the axial length of the conduit blank 20 shortens to accommodate material movement outward to form the annular flange 22.

Figure 17:
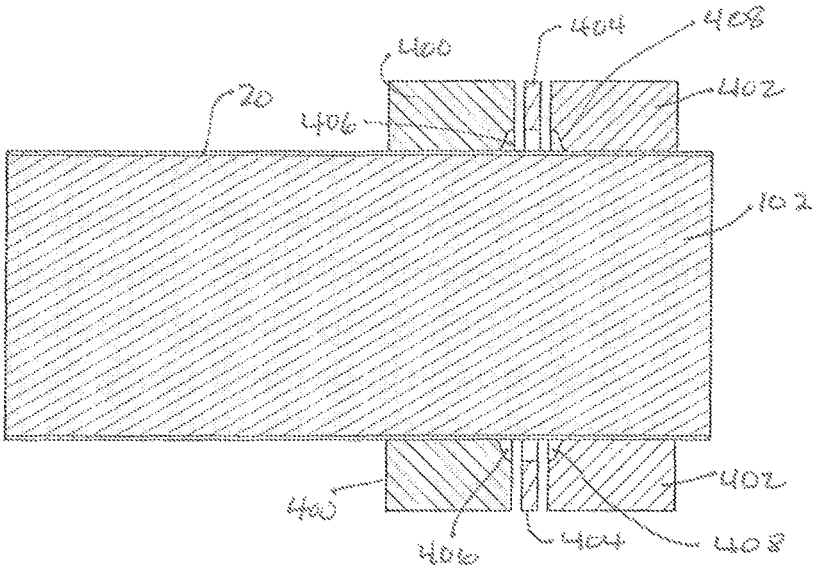
FIG. 17 is a partial cross-sectional view of a conduit blank positioned in a split forming die with axially movable die halves and including a central die retainer used in combination to form a conduit with a bead (annular flange), and prior to forming.
Figure 18:
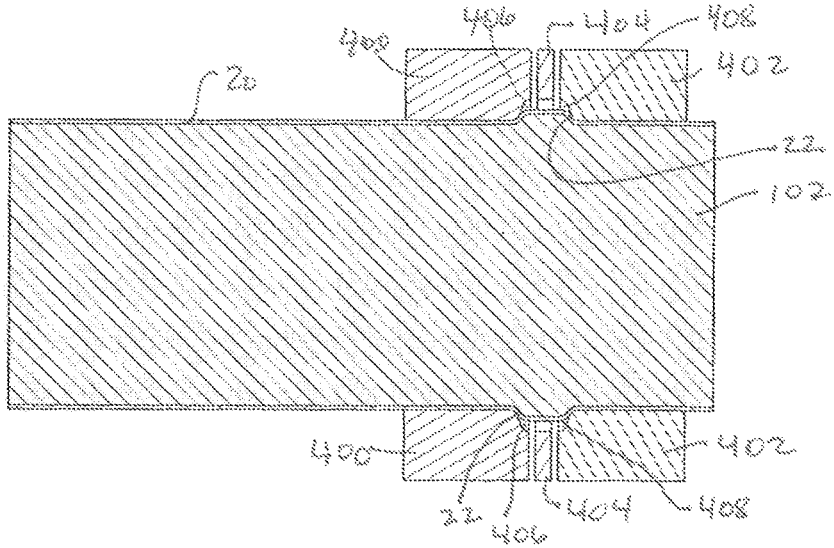
FIG. 18 is the conduit blank and the split forming die with the central die retainer of FIG. 17 in a forming step.
Figure 19:
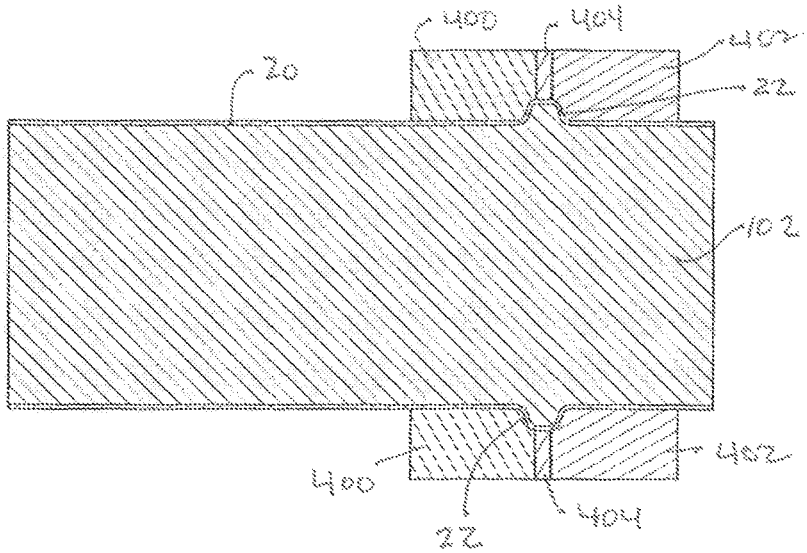
FIG. 19 is the conduit with an annular flange completely formed and the split forming die and central die retainer of FIG. 17.

Another exemplary embodiment of the present invention is illustrated in FIGS. 17 through 19, which illustrate forming an annular ("beaded") flange 22 on a conduit 20 using the elastomer material 102 and a segmented die having a die first half 400, a die second half 402, and a central die retainer 404.

In this embodiment, the two die halves 400 and 402 move toward one another at the same time that force is applied to the elastomer material 102, so that both the die movement and the elastomer compression cooperate to form the annular flange 22. One or both of the die first half 400 and the die second half 402 are movable in an axial direction of the conduit 20 to make contact with the central die retainer 404, as illustrated in FIG. 19.

The die first half 400 defines a portion of an annular recess 406, the die second half 402 defines a mating portion of an annular recess 408, and the central die retainer 404 defines the final portion of the annular recess 408, so that when the die first half 400 and the second die half 402 are adjacent to the central die retainer 404, a complete annular recess is defined, as seen in FIG. 19. The various portions of the recess can be of any desired shape.

In a manufacturing method of this embodiment, according to the present invention, the conduit blank 20 is placed in the die first half 400 and the second die half 402. Each die half 400 and 402 is itself split longitudinally to enable the removal of a formed beaded conduit 20, but the longitudinal split is not visible in figures. The elastomer material 102 can be prepared with sealing wedges, as described above, and an energizing sleeve or a ram can be forced against the elastomer material 102, in the manner described above to translate the axial load of the energizing sleeve or ram into a radial outward pressure applied by the elastomer material 102.

As the radial outward pressure applied by the elastomer material 102 causes the conduit blank 20 to bend and expand outwardly, the die first half 400 is moved toward the die second half 402 (or vice versa) in a synchronized manner, so that the die halves 400 and 402 meet at the central die retainer 404 at about the same time as (or slightly ahead of) the full movement of the elastomer material 102 to complete formation of the annular flange 22. The central die retainer 404 prevents the annular flange 22 from being pinched between the die halves 400 and 402. The central die retainer 404 can also be used to impart a shape on the annular flange 22 that would not otherwise be possible by simply using two die halves.

Preferably, the tube blank 20 is at least partially unrestrained by the die halves 400 and 402 to permit movement of the tube blank 20 in an axial direction as the radial flange 22 is being formed. Preferably, the one (or both) die half 402 does not restrain axial movement of the conduit blank 20, but either or both of the die halves 400 and 402 can move relative to the conduit blank 20. In this manner, the tube blank 20 wall at the location of the radial flange 22 does not need to stretch and become thin when the annular flange 22 is formed because the axial length of the conduit blank 20 shortens to accommodate material movement outward as the annular flange 22 is formed.

There can be some material stretching and thinning with the present embodiment, but the material will not be thinned as much as with other methods. By retaining more conduit wall thickness, the annular flange 22 is more robust than an annular radial flange with a thinner wall. Using die halves 300 and 302 (or 400 and 402) can even enable compression of the conduit 20 wall at the annular flange 22 so that the thickness of the wall can actually increase to create an even more robust annual flange 22.

It should be apparent to those of ordinary skill in the art that the at least one embodiment can be modified without departing from the principles thereof, and no unnecessary limitations from the preceding description should be read into the following claims.

The invention claimed is:

1. A method for forming a conduit with an annular flange in part of a beaded coupling, the method comprising the steps of:

positioning a conduit blank in a forming die, wherein the forming die defines a radial annular recess;

inserting a flexible material into the conduit blank;

compressing the flexible material against the conduit blank to force a portion of the conduit blank outward into engagement with the radial annular recess in the forming die to form a flange in the conduit; and restraining a portion of the conduit blank to prevent axial movement of the restrained portion of the conduit blank, and leaving an axially unrestrained portion of the conduit blank, to permit axial movement of the unrestrained portion of the conduit blank during the step of compressing the flexible material.

2. The method of claim 1, wherein the step of compressing the flexible material comprises the steps of:

inserting a forming post into the conduit blank to define an annular space between the conduit blank and the forming post;

positioning the flexible material in the annular space; and closing a distance between a sleeve and a reaction surface on the forming post.

3. The method of claim 2, wherein the step of closing a distance between the sleeve and the reaction surface comprises the step of:

moving the reaction surface on the forming post toward the sleeve.

4. The method of claim 1, and further comprising the step of:

inserting a sealing wedge adjacent to the flexible material before applying pressure to the flexible material.

5. The method of claim 1, and further comprising the step of:

trimming an end portion off of the conduit.

6. The method of claim 1, and further comprising the step of:

reducing the diameter of an end portion of the conduit.

* * * * *